US008402966B2

(12) United States Patent
Morgan, III et al.

(10) Patent No.: US 8,402,966 B2
(45) Date of Patent: Mar. 26, 2013

(54) AIR PURIFYING RESPIRATOR HAVING INHALATION AND EXHALATION DUCTS TO REDUCE RATE OF PATHOGEN TRANSMISSION

(75) Inventors: Judge Woodrow Morgan, III, Oakboro, NC (US); Amy Elizabeth Staubs, Matthews, NC (US); Michael Parham, Matthews, NC (US); Sioned Owens, Denbigshire (GB); Sean Austerbery, Denbigshire (GB); Gareth Roberts, Wrexham (GB); Troy Alan Baker, Denbigshire (GB)

(73) Assignee: Scott Technologies, Inc., Boca Raton, FL (US)

( * ) Notice: Subject to any disclaimer, the term of this patent is extended or adjusted under 35 U.S.C. 154(b) by 555 days.

(21) Appl. No.: 12/564,978

(22) Filed: Sep. 23, 2009

(65) Prior Publication Data

US 2011/0036347 A1 Feb. 17, 2011

Related U.S. Application Data

(60) Provisional application No. 61/234,136, filed on Aug. 14, 2009.

(51) Int. Cl.
*A62B 23/02* (2006.01)
*A62B 7/10* (2006.01)
*A62B 18/08* (2006.01)

(52) U.S. Cl. ..... 128/201.25; 128/201.22; 128/200.24; 128/205.27; 128/205.29

(58) Field of Classification Search ..... 128/857, 128/863, 200.24, 201.17, 201.25, 205.25, 128/205.27, 205.29
See application file for complete search history.

(56) References Cited

U.S. PATENT DOCUMENTS

| | | | | |
|---|---|---|---|---|
| 4,088,461 | A * | 5/1978 | Brauer | 96/147 |
| 4,592,350 | A * | 6/1986 | Maryyanek et al. | 128/206.17 |
| 5,036,844 | A * | 8/1991 | Pouchot et al. | 128/206.17 |
| 5,463,693 | A * | 10/1995 | Birli et al. | 381/75 |
| 6,460,539 | B1 | 10/2002 | Japuntich et al. | |
| 2004/0226563 | A1 * | 11/2004 | Xu et al. | 128/206.21 |
| 2007/0144524 | A1 | 6/2007 | Martin | |
| 2009/0217926 | A1 * | 9/2009 | Hine et al. | 128/201.25 |

OTHER PUBLICATIONS

Liverman, Catharyn T., et al; "*Respiratory Protection for Healthcare Workers in the Workplace Against Novel H1N1 Influenza A: A Letter Report*"; ISBN: 0-309-14428-0, 68 pages, 2009, http://www.nap.edu/catalog/12748.html.

International Search Report for International (PCT) Patent Application No. PCT/US2010/043876, issued Nov. 15, 2010.

* cited by examiner

*Primary Examiner* — Annette Dixon
(74) *Attorney, Agent, or Firm* — Wyatt B. Pratt

(57) ABSTRACT

A filter mask includes an oronasal cup, an inhalation directional cover, and an exhalation diverter body. The oronasal cup encloses a nose and mouth of a user. The oronasal cup is fluidly coupled with a filter. The inhalation directional cover is configured to be joined to the filter. The inhalation directional cover includes an elongated wing portion that is oriented in an inhalation direction that is angled with respect to the center axis of the filter. The exhalation diverter body is fluidly coupled with the oronasal cup. The exhalation diverter body defines an exhalation duct that directs exhaled air out of the oronasal cup along an exhalation direction. The inhalation direction and the exhalation direction are oriented away from a plane of interaction between the user and another person.

20 Claims, 9 Drawing Sheets

AIR PURIFYING RESPIRATOR HAVING INHALATION AND EXHALATION DUCTS TO REDUCE RATE OF PATHOGEN TRANSMISSION

CROSS-REFERENCE TO RELATED APPLICATIONS

This application claims priority benefit from U.S. Provisional Application Ser. No. 61/234,136, filed Aug. 14, 2009, and entitled "Filter Mask" (the "'136 Application"). The subject matter and disclosure of the '136 Application is hereby incorporated by reference in its entirety.

BACKGROUND OF THE INVENTION

The subject matter herein relates generally to air purifying respirator masks, and more particularly, to respirator masks that filter inhaled and/or exhaled air.

Masks such as respirator masks may be worn by individuals who wish to protect themselves from toxic airborne contaminants such as particulates, vapors and gases. Particulates may be airborne pathogens, toxins, aerosols, and the like. For example, some known filter masks include filters that remove contaminants from air that is inhaled into the masks. Some known filter masks include one or more filters. The filters may be joined to the mask on either side or both sides of the mouth of the person wearing the mask, directly in front of the mouth, or chest mounted with air routed through a breathing tube to the mask. The filters are generally located in a forward position such that the air that is inhaled into the filters is drawn in from the atmosphere in front of and to the opposite sides of the wearer's face.

Air that is exhaled from the filter masks may be expelled from the front of the masks. For example, some known masks direct the exhaled air out of the front of the mask into the atmosphere in front of the wearer's face. Some known masks include an exhalation filter that filters the exhaled air prior to expelling the exhaled air out of the mask. For example, the exhalation filter may remove aerosols and particulates from the exhaled air. Some known masks include an exhalation duct that produces a tortuous path which reduces the likelihood of contaminants leaking into the mask through the exhalation path. For example, the exhalation duct prevents ambient contaminants from entering the area adjacent to the exhalation valve prior to the valve closing during inhalation. Such a duct may not alter the nature or directions in which air is exhaled from the mask.

Some healthcare workers don air purifying respirators when working with patients who are ill. For example, during a pandemic flu outbreak, doctors, nurses, first responders, and other healthcare providers are advised to wear a respirator when treating patients. Healthcare workers may see multiple patients during a standard working shift, not all of which are infected. The healthcare workers may wear the masks to filter inhaled air in an attempt to avoid contracting the same illness from which the patients are suffering. But, the filters on the masks only serve to concentrate the respirable particles of pathogen on the filter media and non-respirable particles on surfaces directly exposed to droplet spray and contact. Transmission of the pathogen can occur by many routes: contact exposure and subsequent hand to face contact, droplet spray exposure through projection by coughing or sneezing of fluid particles with diameters greater than 100 μm, and airborne (inhalation of respirable particles) exposure. The infectious potential and percentage occurrence of each route is dependent upon the specific pathogen, environmental factors, and nature of the healthcare procedure. Many known filters are difficult to clean without damaging the filter media, therefore requiring change out of the filter prior to its normal end of service life to avoid contact exposure and transmission to non-infected patients and the wearer. This places an extra demand for filters and during a pandemic scenario lead to shortages of filters for masks.

Conversely, the healthcare worker that is wearing the respirator mask may be ill. As a result, the air that is exhaled by the worker may contain pathogens that may be transmitted by one or all three of the routes described earlier. Some known exhalation paths on air purifying respirators direct the exhaled air away and in front of the wearer. The exhaled air may contain droplet spray and respirable particles. The droplet spray can contaminate surfaces immediately in front of the wearer including another person who is interacting with the healthcare worker. The respirable particles can be transported directly into the breathing zone of another person who is interacting with the healthcare worker.

Thus, some known filter masks do not adequately protect both the people who wear the filter masks and the people who are interacting with those wearing the filter masks from some potential routes of transmission. The air being filtered is inhaled from the direction of the potentially infected individual and the filter is not protected from surface contamination due to droplet spray. This burdens the filter with a higher concentration of respirable particles to filter and requires filter change out to avoid infection of the wearer or other individuals due to surface contamination of the filter surface. Similarly, contaminated air may be exhaled by persons wearing the masks and infect those persons who are interacting with the persons wearing the masks. A need exists for a filter mask that better protects the people who wear the mask and the people who interact with the persons wearing the masks from contaminated air.

BRIEF DESCRIPTION OF THE INVENTION

In one embodiment, a filter mask is provided. The mask includes an oronasal cup, an inhalation directional cover, and an exhalation diverter body. The oronasal cup encloses the nose and mouth of a user. The oronasal cup is configured to fluidly couple with a filter that filters air passing through the filter along a center axis of the filter and into the oronasal cup. The inhalation directional cover is configured to be joined to the filter. The inhalation directional cover includes an elongated wing portion that is oriented in an inhalation direction that is angled with respect to the center axis of the filter. The exhalation diverter body is fluidly coupled with the oronasal cup. The exhalation diverter body defines an exhalation duct that directs exhaled air out of the oronasal cup along an exhalation direction. The inhalation direction and the exhalation direction are oriented away from a plane of interaction between the user and another person.

In another embodiment, another filter mask is provided. The filter mask includes an oronasal cup, a filter, and an inhalation directional cover. The oronasal cup encloses the nose and mouth of a user. The filter is joined with the oronasal cup. The filter removes contaminants from air inhaled into the interior chamber and through the filter along a center axis of the filter. The inhalation directional cover includes an engagement portion that is rotatably connected to the filter and an elongated wing portion that is oriented in an inhalation direction that is angled away from the center axis of the filter. The inhalation directional cover forms a duct through which air is inhaled into the filter along the inhalation direction. The inhalation directional cover is rotatable around the center axis of the filter to vary orientation of the inhalation direction.

In another embodiment, another filter mask is provided. The mask includes an oronasal cup, an inhalation duct, and an exhalation duct. The oronasal cup encloses the nose and mouth of a user. The inhalation duct is rotatably coupled with the oronasal cup and is fluidly joined with the oronasal cup. The inhalation duct is rotatable with respect to the oronasal cup to vary a location from which air is inhaled from surrounding atmosphere into the oronasal cup. The exhalation duct is fluidly coupled with the oronasal cup. The exhalation duct directs exhaled air downward from the oronasal cup with respect to the nose and mouth of the user into the surrounding atmosphere. The inhalation duct and the exhalation duct direct intake and exhalation of air, respectively, along directions away from a plane of interaction between the user and another person with whom the user is interacting.

DETAILED DESCRIPTION OF THE INVENTION

Figure 1:
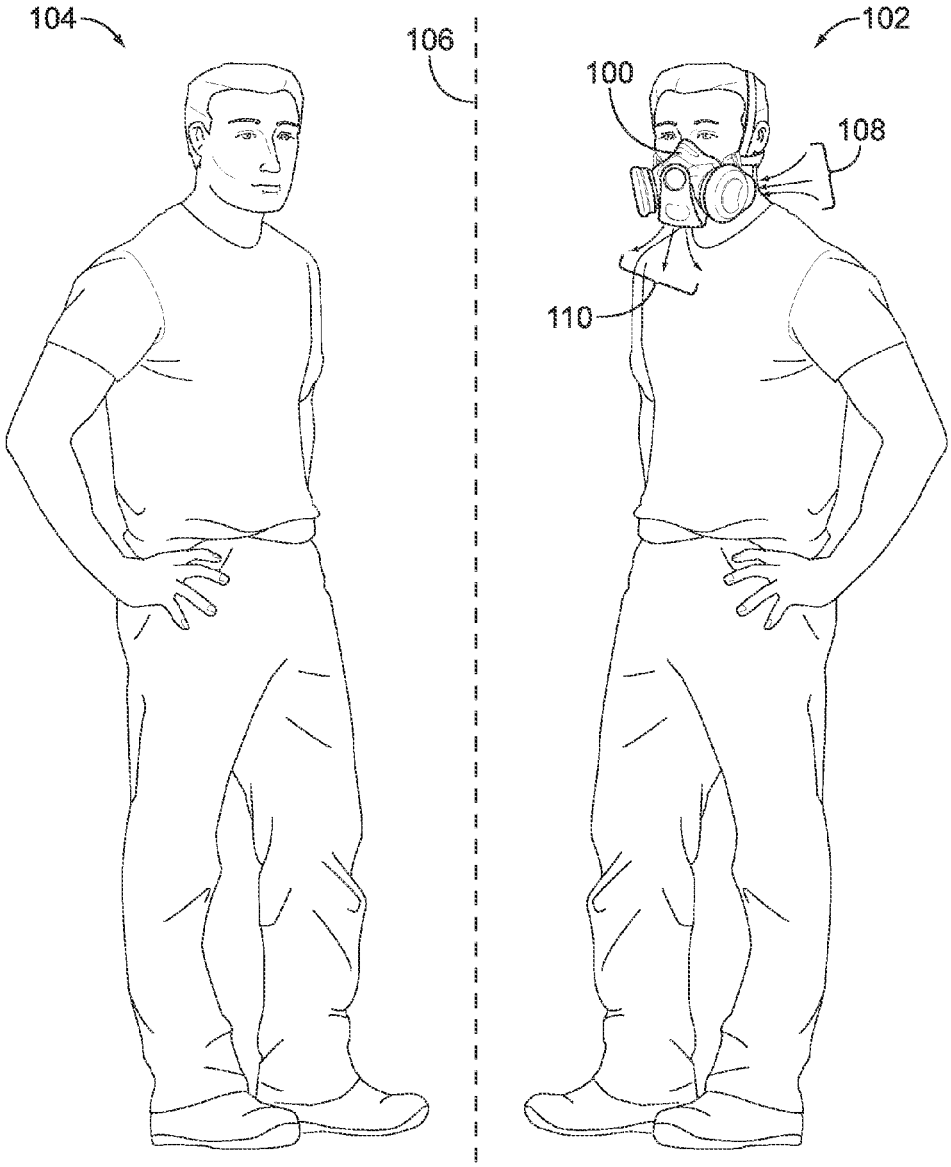
FIG. 1 is an illustration of a human user wearing a filter mask during interaction with another person in accordance with one embodiment of the present disclosure.

FIG. 1 is an illustration of a human user 102 wearing a filter mask, or respirator, 100 during interaction with another person 104 in accordance with one embodiment of the present disclosure. The filter mask 100 protects the user 102 that is wearing the filter mask 100 from inhalation of airborne contaminants, such as foreign bodies, pathogens, bacteria, toxins, aerosols, and contamination of the oronasal region by droplet spray by controlling the direction(s) in which air is inhaled into the mask 100. The filter mask 100 may protect other persons 104 from air that is exhaled by the user 102 from the filter mask 100 by controlling the direction(s) in which the exhaled air is directed. For example, the user 102 may be a healthcare professional and the user 104 may be a patient being examined or treated by the user 102. A plane of interaction 106 is a spatial plane or interface between the users 102, 104 and through which the users 102, 104 interact. By way of example only, the plane of interaction 106 between the users 102, 104 may be a plane located equidistant from the mouths and/or noses of the users 102, 104. The plane of interaction 106 between the users 102, 104 may be a plane located equidistant from the oronasal region of the user 102 and the exhaust of equipment which is contaminated with pathogens from user 104.

The filter mask 100 includes ducts that direct air to be inhaled by the user 102 generally along inhalation directions 108 from the atmosphere surrounding the user 102. As shown in FIG. 1, as the user 102 inhales, the filter mask 100 draws air along the inhalation directions 108 into the filter mask 100 from behind the user 102 and in a location that is remote from the plane of interaction 106. For example, the filter mask 100 may draw air from a location that is remote from the user 104 such that the user 102 and the filter mask 100 are disposed between the location where the air is drawn from and the user 104. In one embodiment, the orientations of the inhalation directions 108 may be varied by the user 102. For example, the user 102 may change the inhalation directions 108 to draw air from different locations, such as below the filter mask 100, above the head of the user 102, from in front of the user 102 between the user 102 and the plane of interaction 106, and the like. The drawing of inhaled air from locations away from the plane of interaction 106 may reduce the concentration of respirable contaminants in the inhaled air and prevent droplet spray from directly impacted on the filter cartridge 204. For example, if the user 104 is ill, the air that is remote from the user 104 may contain less pathogens than the air between the users 102, 104. Additionally, the inhalation directions 108 may be varied to avoid having the user 102 inhale his or her exhaled air. For example, the inhalation directions 108 may draw air in from locations disposed away from the areas below the user's 102 face. The inhalation directions 108 may also be varied based on the plane of interaction 106.

The filter mask 100 includes one or more ducts that direct air that is exhaled by the user 102 along exhalation directions 110 into the atmosphere surrounding the user 102. As shown in FIG. 1, as the user 102 exhales, the filter mask 100 directs the exhaled air out of the filter mask 100 and along the exhalation directions 110 directed away from the plane of interaction 106. For example, the filter mask 100 may direct exhaled air away from the plane of interaction 106 and the user 104. In one embodiment, the exhaled air is directed downward with respect to the nose and mouth of the user 102.

The directing of exhaled air to locations away from the plane of interaction 106 and the user 104 may reduce the concentration of respirable contaminants in the air surrounding the user 104 and prevent droplet spray from impacting the user 104 and the surrounding area. For example, if the user 102 is ill, exhaled air from the user 102 that is contaminated with one or more pathogens is directed away from the user 104 to avoid spreading the disease borne by the user 102.

Figure 2:
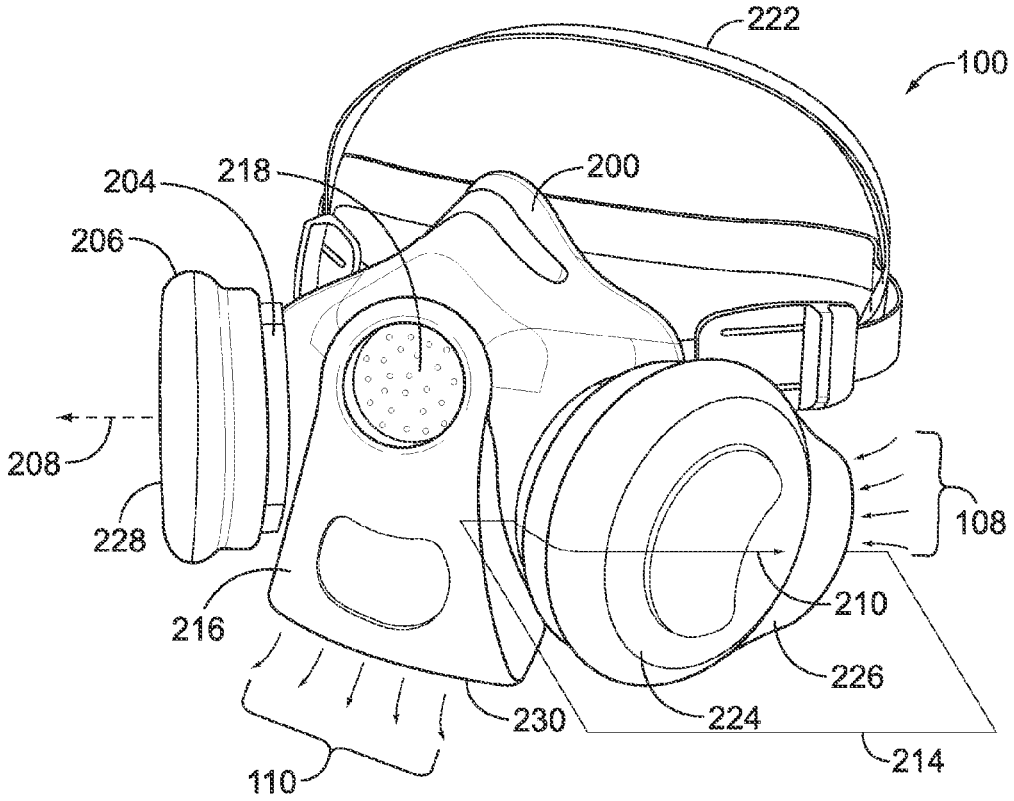
FIG. 2 is a perspective view of the filter mask shown in FIG. 1 in accordance with one embodiment.

FIG. 2 is a perspective view of the filter mask 100 in accordance with one embodiment. The filter mask 100 is shown as a half-mask, but may be a full face mask or hood. The filter mask 100 includes an oronasal cup 200 that encloses a wearer's nose and mouth within an interior chamber 1000 (shown in FIG. 12) defined by the oronasal cup 200. In one embodiment, the oronasal cup 200 may be a nosecup. The filter mask 100 is joined with several straps 222 that couple the filter mask 100 to the wearer's head. Although not visible in the view shown in FIG. 2, the filter mask 100 includes inhalation ports 202 (shown in FIG. 3) on opposite sides of the oronasal cup 200 in the illustrated embodiment. The inhalation ports 202 provide openings extending into the interior chamber 1000 of the oronasal cup 200. A different number of inhalation ports 202 may be provided than those shown in the illustrated embodiments. Air that is inhaled by the wearer of the filter mask 100 enters into the oronasal cup 200 through the inhalation ports 202. In the illustrated embodiment, filters 204 are coupled with the inhalation ports 202 such that the filters 204 are fluidly coupled with the interior chamber 1000 of the oronasal cup 200 and filter air that is inhaled into the oronasal cup 200 through the inhalation ports 202. The filters 204 may be particulate filters or a combination filter. In one embodiment, the filters 204 are NIOSH P-100 filters. In another embodiment, the filters 204 are combination filters such as NIOSH P-100 filters with NIOSH OV chemical protection. The filters 204 may be replaceable or may be permanently mounted to the mask 100.

Inhalation directional covers 206 are coupled with the filters 204. The directional covers 206 may protect the filters 204 from being contaminated by droplet spray from people in the vicinity of the wearer of the mask 100. For example, the outer surface 228 may block the majority of a droplet spray directed toward the filter 204 from reaching the filter 204. The directional covers 206 may control the direction in which air is inhaled into the oronasal cup 200 from the atmosphere surrounding the filter mask 100. For example, the directional covers 206 may permit the intake of air into the filters 204 and the oronasal cup 200 from the atmosphere along the inhalation directions 108 while preventing the air to be drawn into the filter mask 100 along other directions or from other locations. The directional covers 206 shown in FIG. 2 have a body with an outer surface 228 that faces outward from the mask 100. In the illustrated embodiment, the directional covers 206 have an oblong shape that extends around the periphery of the corresponding filters 204 and have overhanging portions that extend outward from the filters 204. For example, the directional covers 206 have a coupling portion 224 that extends around the filter 204 and a wing portion 226 that extends outward from the periphery of the filter 204. The coupling portion 224 is approximately circular in the illustrated embodiment and is rotatably coupled to the filter 204. Alternatively, the coupling portion 224 may have a different shape. The wing portion 226 is elongated and off-center from the coupling portion 224 along an elongation direction 212.

The wing portion 226 may be elongated from the coupling portion 224 such that the directional covers 206 have a shape that is symmetrical about a plane 214 extending through the elongation direction 210 but not about any other plane. For example, the directional covers 206 may be symmetric on opposite sides of the plane 214 but not on opposite sides of a plane that is oblique with respect to the plane 214. As described below, the elongation direction 210 of the wing portion 226 may determine the inhalation directions 108 at which air is drawn into the filter mask 100.

The directional covers 206 may draw air along inhalation directions 108 that generally oppose, or are generally oppositely oriented with respect to, the elongation direction 210. For example, as described below, air is inhaled into the directional covers 206 through the wing portions 226. Varying the location or orientation of the wing portions 226 relative to the mask 100 may likewise vary the orientation of the inhalation end elongation directions 108, 210 and the location from which air is drawn into the mask 100. The inhalation and elongation directions 108, 210 may be generally oriented opposite of one another. In one embodiment, the directional covers 206 are rotatably coupled with the filters 204 such that the directional covers 206 may rotate with respect to the oronasal cup 200 and the filters 204. For example, the directional covers 206 may rotate around a center axis 208 of the filters 204 to vary the orientation of the elongation direction 210 with respect to the nose mask 200. In one embodiment, the directional covers 206 may rotate 360 degrees around the center axis 208. Alternatively, the directional covers 206 may rotate less than 360 degrees around the center axis 208. In the illustrated embodiment, the elongation directions 212 of the directional covers 206 are angled with respect to the center axes 208 of the corresponding filters 204. For example, the elongation direction 212 may be obliquely oriented with respect to the center axis 208 or approximately perpendicularly oriented with respect to the center axis 208.

Changing the orientation of the elongation direction 210 may alter the orientation of the inhalation directions 108 with respect to the oronasal cup mask 200. The orientation of the elongation direction 210 shown in FIG. 2 causes air to be inhaled from around the wearer's ears. Rotating the directional covers 206 downward from the ears may orient the elongation direction 210 down below the ears and cause inhaled air to be drawn from below the wearer's ears. Rotation of the directional covers 206 in other directions may cause the inhaled air to be drawn from other locations. For example, if a doctor wearing the filter mask 100 is interacting or working on an ambulatory, or upright, patient, the doctor may rotate the directional cover 206 so that the elongation direction 210 is oriented in a direction extending below the doctor's ears. As a result, the inhalation directions 108 may draw air that is located behind and/or below the doctor, as opposed to drawing air that surrounds or is in close proximity of the standing patient. Alternatively, if the doctor wearing the mask 100 is working with a patient that is lying down, the doctor may rotate the directional cover 206 so that the elongation direction 210 is oriented in a direction extending above and behind the doctor's ears. The air that is drawn by the directional cover 206 may be limited to air that is located above and/or behind the doctor and away from the prone patient.

The directional covers 206 may include an indicator that provides a visual, audible, and/or tactile indication of a position or orientation of the elongation direction 210 and/or inhalation directions 108. For example, the directional cover 206 may include a protruding alignment tab (not shown) that visually indicates the orientation of the elongation direction 210 and/or inhalation directions 108. The tab may point in the elongation direction 210 or the inhalation directions 108. Alternatively, the directional cover 206 may include dots or other visual indicia that represent the orientation of the elongation direction 210 and/or the inhalation directions 108. In another embodiment, the directional cover 206 may include inwardly extending protrusions or nubs that engage corresponding cavities in the filter cover 300 (shown in FIG. 3) or filter 204. The protrusions may provide an audible and/or tactile "click" each time the protrusions are rotated into or out of the cavities. The clicking may indicate the orientation of the elongation direction 210 and/or inhalation directions 108 relative to the mask 100. The wearer may use the indicator to ensure that both of the directional covers 206 have the elongation directions 210 and/or inhalation directions 108 respectively oriented in the same or similar directions relative to the filter mask 100.

The directional covers 206 may be removable from the filter 204. For example, after a wearer of the mask 100 has completed his or her use of the mask 100 and/or filter 204, the directional cover 206 may be decoupled from the filter 204 and decontaminated for re-use. The directional covers 206 may be removed, cleaned, and reused without need to remove or replace the filters 204. Alternatively, the directional covers 206 may be cleaned with the mask 100, filters 204, and covers 300 (shown in FIG. 2) coupled to one another without the need to remove or replace the filter 204 prior to or after cleaning. This later scenario allows the wearer to clean the outer surfaces of the mask 100 without removing the mask 100, thereby allowing the wearer to stay in an area that may be free of airborne droplet spray but still contaminated with respirable pathogens. In order to clean the directional covers 206, the covers 206 may be placed into a liquid bath, which may not be a viable option for a particulate filter 204. Additionally, the filter mask 100 may be cleaned and/or decontaminated for re-use. For example, the filters 204 may be removed and the mask 100 placed into a liquid bath to be cleaned. In another example, the directional covers 206 and filter mask 100 may be wiped down in-between patient visits during the duration of the shift to decontaminant the surface without requiring the removal of the mask 100 and filter 204 to maintain protection from respirable particles.

The filter mask 100 includes an exhalation diverter body 216 that directs exhaled air out of the filter mask 100 along the exhalation directions 110. The diverter body 216 and the oronasal cup 200 may be a unitary body. For example, the diverter body 216 and the oronasal cup 200 may be molded as a single body. Alternatively, the diverter body 216 and the oronasal cup 200 may be separate bodies that are coupled together. The diverter body 216 may include, or be formed from, an electromeric material that is relatively flexible. The flexibility of the diverter body 216 can permit the body 216 to be bent upward in such a manner so as to permit cleaning of the inside surfaces of the body 216. The flexibility of the diverter body 216 may allow a wearer to inspect the diverter body 216 by bending and otherwise manipulating the body 216 to see behind the body 216 and between the body 216 and the oronasal cup 200 without having to separate the body 216 from the cup 200. The diverter body 216 provides one or more exhalation ports 306, 308 (shown in FIG. 3) at a lower end 230 of the exhalation diverter body 216 that are fluidly coupled with the interior chamber 1000 (shown in FIG. 12) of the nose mask 200. The ports 306, 308 are provided at the lower end 230 of the diverter body 216 to permit the exhaled air to exit the filter mask 100 in a generally downward direction away from the plane of interaction 106 (shown in FIG. 1) between the wearer of the mask 100 and one or more other persons.

In the illustrated embodiment, the filter mask 100 includes a voice transmitter 218 that is coupled with the diverter body 216. The voice transmitter 218 may be a mechanical voice transmitter formed of a body that mechanically vibrates in response to the wearer's voice to transmit the wearer's voice outside of the mask 100. The transmitter 218 may operate without electricity and may not include any electronic components. The wearer's voice is transmitted from within the mask 100 to outside of the mask 100 by the vibrations of the transmitter 218. The transmitter 218 may convey the wearer's voice with relatively little distortion such that the wearer may easily communicate with others while wearing the mask 100.

Figure 3:
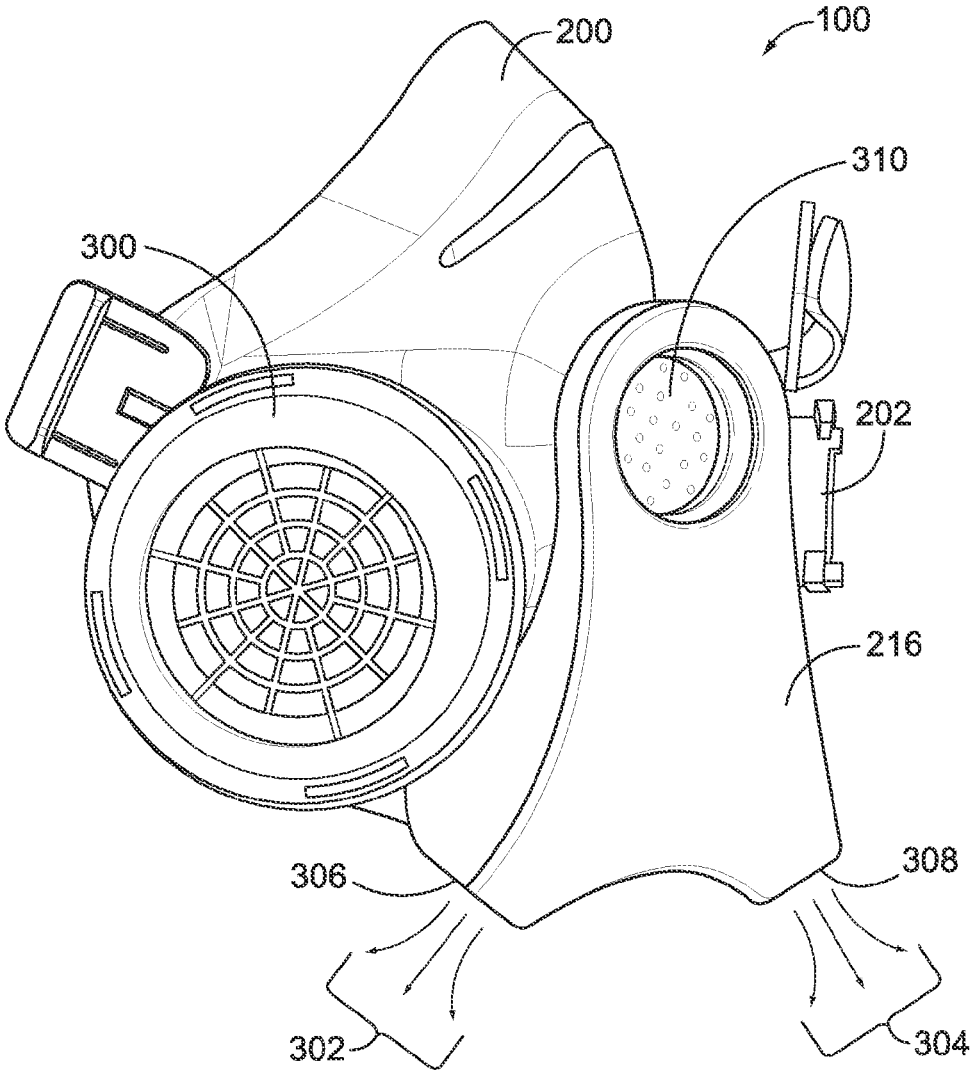
FIG. 3 is a partial cut-away view of the filter mask shown in FIG. 1 in accordance with one embodiment of the present disclosure.

FIG. 3 is a partial cut-away view of the filter mask 100 in accordance with one embodiment of the present disclosure. The filter mask 100 is shown with the left half of the oronasal cup 200 removed, the filter 204 (shown in FIG. 2) removed from the left inhalation port 202, the inhalation directional covers 206 (shown in FIG. 2) removed, and the voice transmitter 218 (shown in FIG. 2) removed from the exhalation diverter body 216. In the illustrated embodiment, the exhalation diverter body 216 includes an opening 310 extending there through. The opening 310 may receive a component, such as the voice transmitter 218, that is held in place by the diverter body 216.

The filter mask 100 includes a filter cover 300 joined to the filter 204 (shown in FIG. 2). The filter cover 300 may be coupled with the filter 204 such that the filter cover 300 is located between the filter 204 and the inhalation directional cover 206. The filter cover 300 may hold a pre-filter element 502 (shown in FIG. 5) between the filter cover 300 and the filter 204. The pre-filter element 502 is designed to remove relatively larger droplets from the inhaled air prior to the inhaled air being received into the filter 204. Removing the relatively larger droplets may extend the life of the filter 204 and reduce or prevent contamination of the filter 204. For example, the pre-filter element 502 that is held by the filter cover 300 may prevent aerosols, such as ballistic aerosols projected by an ill person that sneezes or coughs, from damaging or entering into the filter 204. The filter cover 300 may be removably coupled to the filter 204. The filter cover 300 can be removed from the filter 204 to clean and/or sanitize the filter cover 300 between uses of the filter mask 100. For example, while the filter 204 may not be able to be submerged into a liquid cleaning bath to sanitize the filter 204, the filter cover 300 may be removed from the filter 204 and submerged in the bath to clean and sanitize the filter cover 300.

The exhalation diverter body 216 shown in FIG. 3 includes divergent exhalation ports 306, 308 that direct exhaled air out and away from the filter mask 100 along diverging exhalation airflow paths 302, 304. While two ports 306, 308 and airflow paths 302, 304 are shown in FIG. 3, alternatively a different number of ports 306, 308 and/or paths 302, 304 may be provided. The airflow paths 302, 304 may be aligned or coextensive with the exhalation directions 110 (shown in FIG. 1). For example, the airflow paths 302, 304 may represent the exhalation directions 110 or a subset of the exhalation directions 110. The exhalation airflow paths 302, 304 may be oriented downward and toward the shoulders of the wearer of the mask 100 in the illustrated embodiment. Alternatively, the airflow paths 302, 304 may be directed elsewhere. The airflow paths 302, 304 are oriented in directions that prevents exhaled air from the wearer of the mask 100 from flowing toward a patient or other person with whom the wearer of the mask 100 is working. For example, the airflow paths 302, 304 may direct air away from an ambulatory patient with whom a wearer of the mask 100 is working or interacting.

Figure 5:
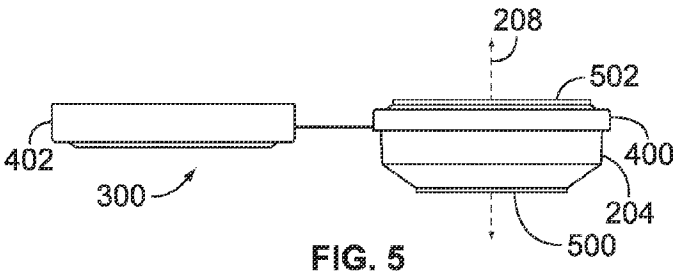
FIG. 5 is an elevational view of the filter cover shown in FIG. 4 in accordance with one embodiment of the present disclosure.
Figure 7:
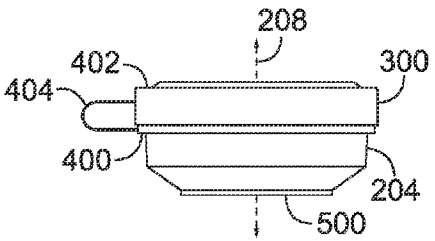
FIG. 7 is an elevational view of the filter cover shown in FIG. 6 in accordance with one embodiment of the present disclosure.
Figure 4:
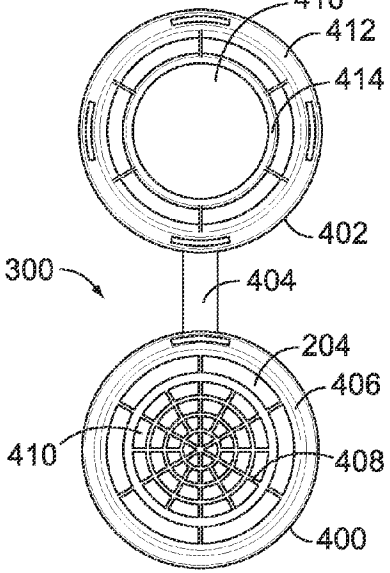
FIG. 4 is a top view of a filter cover shown in FIG. 3 in an open position and coupled to a filter shown in FIG. 2 in accordance with one embodiment of the present disclosure.
Figure 6:
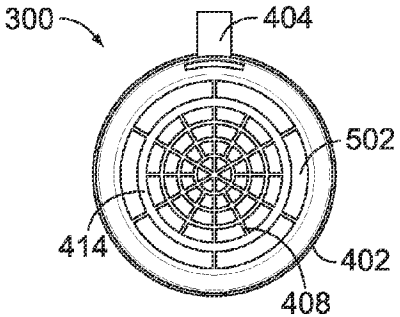
FIG. 6 is a top view of the filter cover shown in FIG. 3 in a closed position and coupled to the filter shown in FIG. 2 in accordance with one embodiment of the present disclosure.

FIG. 4 is a top view of the filter cover 300 in an open position and coupled to the filter 204 in accordance with one embodiment of the present disclosure. FIG. 5 is an elevational view of the filter cover 300 shown in FIG. 4. FIG. 6 is a top view of the filter cover 300 in a closed position and coupled to the filter 204 in accordance with one embodiment of the present disclosure. FIG. 7 is an elevational view of the filter cover 300 shown in FIG. 6. The filter cover 300 is coupled to the filter 204 at an intake interface 810 (shown in FIG. 8) of the filter 204. For example, the filter cover 300 may engage the filter 204 around the intake interface 810 of the filter 204. An outlet interface 500 (shown in FIG. 5) of the filter 204 is disposed opposite of the intake interface 810 along the center axis 208 of the filter 204. Air is drawn and filtered by the filter 204 by entering the filter 204 through the intake interface 810, passing through filter media housed in the filter 204, and exiting the filter 204 through the outlet interface 500. The outlet interface 500 is fluidly coupled with the interior chamber 1000 (shown in FIG. 12) of the oronasal cup 200 (shown in FIG. 2) to provide filtered air to the wearer of the filter mask 100 (shown in FIG. 1). For example, air that exits the outlet interface 500 enters the oronasal cup 200 and is inhaled by the wearer. In the illustrated embodiment, the center axis 208 is disposed through the center of the filter 204. Alternatively, the center axis 208 may be off-center in the filter 204. The air that passes through the filter 204 may pass through the filter 204 in directions that are approximately parallel to the center axis 208.

In the illustrated embodiment, the filter cover 300 includes an engagement portion 400 and an enclosure portion 402. The engagement portion 400 and the enclosure portion 402 may have an approximately circular shape as shown in FIGS. 4 through 7, or may have a different shape. The engagement portion 400 and enclosure portion 402 may have shapes that conform to the filter 204 such that inhaled air cannot enter the filter 204 without first passing through the filter cover 300. The engagement portion 400 and enclosure portion 402 are coupled to one another by a hinge 404. Alternatively, the engagement portion 400 and enclosure portion 402 are removably coupled to one another such that the portions 400, 402 may be separated into two distinct bodies. The hinge 404 may be a living hinge in the illustrated embodiment. The engagement portion 400, enclosure portion 402, and the hinge 404 may be formed as a unitary body. For example, the portions 400, 402 and hinge 404 may be molded from one or more polymers. Alternatively, two or more of the portions 400, 402 and the hinge 404 may be separate bodies.

The engagement portion 400 engages the filter 204 around the periphery of the filter 204. For example, the engagement portion 400 may surround the intake interface 810 (shown in FIG. 8) of the filter 204. The engagement portion 400 may be secured to the filter 204 by a snap-fit engagement. The engagement portion 400 includes a ring body 406 that defines a center opening 410. Inhaled air passes through the engagement portion 400 through the center opening 410. The engagement portion 400 includes a grill 408 that is coupled to the ring body 406 and extends across the center opening 410. The grill 408 provides a supporting structure that holds a pre-filter element 502 (shown in FIG. 5) above the intake interface 810 of the filter 204. For example, the grill 408 may support the pre-filter element 502 upstream of the filter 204 such that inhaled air passes through the pre-filter element 502 prior to entering the filter 204.

The pre-filter element 502 is a filtration body that may protect the filter 204 by preventing transport of droplets, aerosols, and the like into the filter 204. For example, the pre-filter element 502 may be a sheet of fibrous filter media, such as a paper filter media, that prevents ballistic aerosols from passing into the filter 204. Preventing aerosols, such as the matter from a sneezing patient, from entering into the filter 204 may protect the filter 204 from damage and permit the filter 204 to be used for longer periods of time. For example, the interior of the filter 204 may not be able to be cleaned if a sick patient's mucous enters into the filter 204. The pre-filter element 502 may prevent such aerosols from entering the filter 204 so as to avoid the need to replace the filter 204 if a sick patient's mucous enters into the filter 204.

The pre-filter element 502 is placed onto the grill 408 of the engagement portion 400. The enclosure portion 402 may be coupled to the engagement portion 400 to enclose the pre-filter element 502 within the filter cover 300. In the illustrated embodiment, the enclosure portion 402 includes an outer ring body 412 joined to an inner ring body 414. A central opening 416 is located within and is framed by the outer ring body 412. The inner ring body 414 is disposed within the central opening 416. The central opening 410 of the engagement portion 400 and the central opening 416 of the enclosure portion 402 align with one another to provide an opening through the filter cover 300 that permits air to pass into the filter 204.

The enclosure portion 402 is removably coupled to the engagement portion 400. For example, the outer ring body 412 may snap-fit to the ring body 406 of the engagement portion 400 to secure the enclosure portion 402 to the engagement portion 400. In one embodiment, the enclosure portion 402 is elastomeric or includes an elastomeric rim that is stretched around the engagement portion 400 to secure the enclosure portion 402 to the engagement portion 400. One or more of the ring bodies 412, 414 secures the pre-filter element 502 between the engagement and enclosure portions 400, 402. For example, the inner ring body 414 may prevent removal of the pre-filter element 502 from the filter cover 300 through the enclosure portion 402 and the grill 408 may prevent removal of the pre-filter element 502 from the filter cover 300 through the engagement portion 400.

Figure 8:
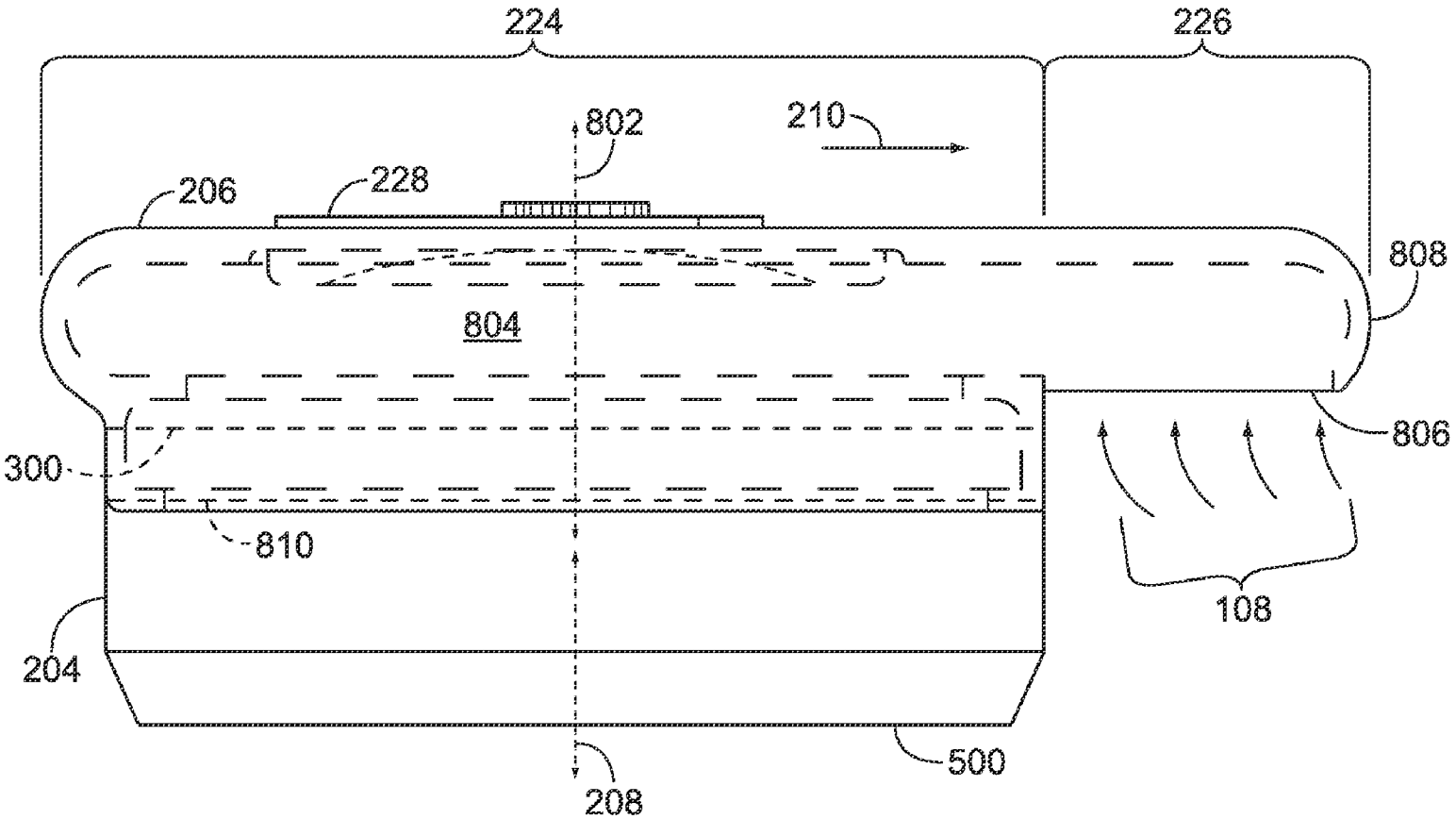
FIG. 8 is an elevational view of an inhalation directional cover shown in FIG. 2 coupled to the filter also shown in FIG. 2 in accordance with one embodiment of the present disclosure.

FIG. 8 is an elevational view of the inhalation directional cover 206 in accordance with one embodiment of the present disclosure. The directional cover 206 may be rotatably coupled with the filter cover 300 mounted to the filter 204 or may be directly mounted to the filter 204. As described above, the directional cover 206 may rotate about the center axis 208 of the filter 204 relative to the filter 204 to vary the orientation of the elongation direction 210 of the directional cover 206. In one embodiment, the filter cover 300 remains approximately stationary with respect to the filter 204 while the directional cover 206 rotates about the center axis 208 relative to the filter cover 300 and the filter 204. In another embodiment, the directional cover 206 and the filter cover 300 both rotate around the center axis 208 relative to the filter 204. For example, the filter cover 300 may rotate with the directional cover 206.

As described above, the directional cover 206 is a body that is coupled to the filter 204 to direct the flow of air that is inhaled into the filter 204. For example, the directional cover 206 permits air to be drawn into the filter 204 from one or more directions generally along the inhalation directions 108 while preventing air from being drawn into the filter 204 from one or more other directions or locations outside of the directional cover 206.

The coupling portion 224 is a generally cylindrical body that defines a plenum 804 through which inhaled air passes when the wearer of the mask 100 (shown in FIG. 1) inhales. The coupling portion 224 extends between a connection end 800 and the outer surface 228 along a rotation axis 802. The outer surface 228 is a closed surface in the illustrated embodiment. For example, the outer surface 228 may be a surface or wall that does not permit air or fluid to pass through the directional cover 206 and into the plenum 804. The connection end 800 is rotatably mounted to the filter 204. For example, the connection end 800 may be an approximately circular open end of the coupling portion 224 that extends around the periphery of the filter 204. The connection end 800 provides an opening through which inhaled air passes from the plenum 804 and into the filter 204. The rotation axis 802 is the axis about which the directional cover 206 rotates relative to the mask 100. In one embodiment, the rotation axis 802 is parallel to or coextensive with the center axis 208 of the filter 204 to which the directional cover 206 is mounted. Alternatively, the rotation axis 802 may be angled with respect to the center axis 208 of the filter 204.

The wing portion 226 is an elongated projection that extends from the coupling portion 224 along the elongation direction 210. As shown in FIG. 8, the wing portion 226 overhangs from the coupling portion 224 such that the wing portion 226 appears as a cantilevered beam in an elevational view. The wing portion 226 extends from an intake end 806 and the outer surface 228 in a direction parallel to the rotation axis 802 and from the coupling portion 224 to an outer end 808 in a direction that is parallel to the elongation direction 210. In the illustrated embodiment, the intake end 806 defines an opening through which inhaled air enters the directional cover 206. For example, the wing portion 226 may be substantially closed with the outer surface 228 and the outer end 808 preventing the ingress of air or fluid into the plenum 804 while the intake end 806 may include one or more openings through which inhaled air enters the plenum 804. The intake end 806 may be open from the coupling portion 224 to the outer end 808. Alternatively, the intake end 806 may be a closed surface similar to the outer surface 228 with one or more openings extending through the intake end 806. For example, the intake end 806 may include a filter media or body that filters inhaled air prior to entering the plenum 804.

The directional cover 206 may be substantially sealed from the surrounding atmosphere but for the intake end 806 of the wing portion 226. For example, the body of the directional cover 206 may prevent the ingress of air or fluid into the plenum 804 except for through the intake end 806. The orientation of the intake end 806 relative to the mask 100 (shown in FIG. 1) may then determine the locations from which air is drawn into the directional cover 206 and the mask 100. The wing portion 226 may define the inhalation duct or conduit through which inhaled air is drawn into the filter 204 (shown in FIG. 2) to which the directional cover 206 is mounted. Air that is inhaled by a wearer of the filter mask 100 is drawn into the directional cover 206 along the inhalation directions 108 and through the intake end 806. The air passes through the intake end 806 and into the plenum 804. The air travels through the plenum 804 and into the filter 204 through the connection end 800. The air enters the filter 204 through the intake interface 810 in directions that are generally parallel to the center axis 208. The filter 204 removes contaminants, such as pathogens, aerosols, toxins, airborne particulates, and the like, from the air as the air passes through the filter 204. The filtered air exits the filter 204 from the outlet interface 500 of the filter 204 and into the oronasal cup 200 (shown in FIG. 2). The filtered air is then inhaled by the wearer of the filter mask 100 (shown in FIG. 1).

In one embodiment, the plenum 804 may be sufficiently large such that the directional cover 206 does not significantly restrict airflow into the filter 204. By way of example only, the plenum 804 may define a conduit that has a cross-sectional area for inhaled airflow that is as large as or larger than the cross-sectional area of the intake interface 810 of the filter 204. Alternatively, the plenum 804 may have a cross-sectional area that is no larger than the cross-sectional area of the intake interface 810 of the filter 204 while not significantly restricting airflow into the filter 204. The cross-sectional area of the plenum 804 may be measured between filter cover 300 and the outer surface 228 of the directional cover 206 in a plane that is parallel to the rotation axis 802. The plenum 804 may be sufficiently large to prevent the inhaled air from being only drawn through a channel or subsection of the cross-sectional area of the filter 204. For example, the plenum 804 may be large enough to ensure that the airflow through the filter 204 is approximately evenly distributed across the intake interface 810 and not concentrated through one or more portions of the intake interface 810.

In one embodiment, the directional cover 206 may be used to perform a negative pressure leak check on the filter mask 100 (shown in FIG. 1). Once a wearer dons the mask 100, the wearer may depress the outer surface 228 inward toward the intake interface 810 of the filter 204 until the air passageway extending from outside of the directional cover 206 and into the intake interface 810 through the plenum 804 is closed off. The wearer may then attempt to inhale. If a leak between the wearer's face and the mask 100 exists, or if the wearer is donning a mask 100 that is too large or small, then air may be inhaled into the mask 100 through the leak or gap, instead of through the directional cover 206. If no leak exists or if the size of the mask 100 is correct, then the wearer may be unable to inhale into the mask 100.

Figure 9:
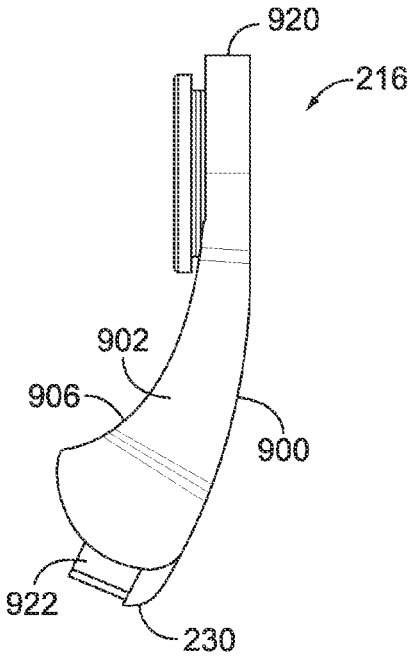
FIG. 9 is a side view of an exhalation diverter body shown in FIG. 2 in accordance with one embodiment of the present disclosure.
Figure 10:
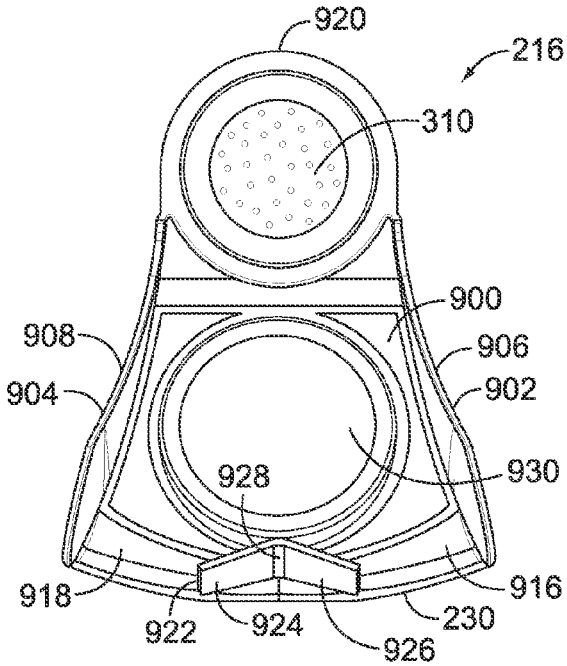
FIG. 10 is a rear view of the exhalation diverter body shown in FIG. 2 in accordance with one embodiment of the present disclosure.
Figure 11:
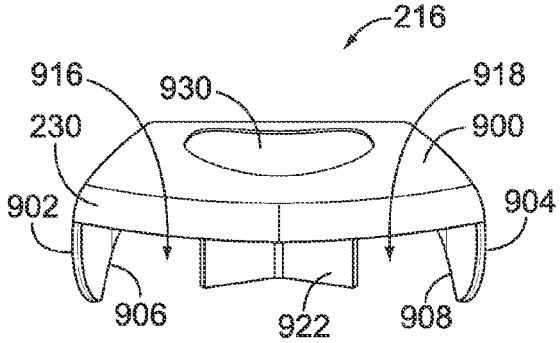
FIG. 11 is a bottom view of the exhalation diverter body shown in FIG. 2 in accordance with one embodiment of the present disclosure.

FIG. 9 is a side view of the exhalation diverter body 216 in accordance with one embodiment of the present disclosure. FIG. 10 is a rear view of the exhalation diverter body 216 shown in FIG. 9. FIG. 11 is a bottom view of the exhalation diverter body 216 shown in FIG. 9. The exhalation diverter body 216 may be a flexible body formed from a dielectric or elastomeric material, such as one or more polymers. The exhalation diverter 216 may be fixed to the mask 100 (shown in FIG. 1) or the oronasal cup 200 (shown in FIG. 2) such that the exhalation diverter body 216 cannot be separated from the mask 100 or oronasal cup 200 without damaging the diverter 216. Alternatively, the exhalation diverter body 216 may be removably coupled to the oronasal cup 200.

The exhalation diverter body 216 includes a deflection plate 900 that laterally extends between two opposing outer walls 902, 904. The deflection plate 900 has an arcuate shape in the illustrated embodiment. For example, the deflection plate 900 has a swept back shape that extends rearward toward the wearer of the mask 100 (shown in FIG. 1). As shown in FIG. 10, the outer walls 902, 904 extend up the sides of the body 216 and arcuately extend along the top of the body 216 to a rounded top side 920 where the outer walls 902, 904 meet. Alternatively, the top side 920 may have a non-arcuate shape. As shown in FIG. 10, the top side 920 arcuately extends around a portion of the circumference of the opening 310. The deflection plate 900 also longitudinally extends between the top side 920 to the lower end 230. The outer walls 902, 904 extend from the deflection plate 900 to corresponding sealing edges 906, 908 in directions that are obliquely or perpendicularly oriented with respect to the deflection plate 900. The sealing edges 906, 908 may engage the oronasal cup 200 (shown in FIG. 2) to define a plenum between the exhalation diverter body 216 and the oronasal cup 200. The sealing edges 906, 908 may be sealed to the oronasal cup 200 to prevent air from being passing through an interface between the oronasal cup 200 and the sealing edges 906, 908.

In the illustrated embodiment, the deflection plate 900 includes a diverter plate 922 disposed at the lower end 230 of the body 216. The diverter plate 922 is positioned between the walls 902, 904 to define exhalation ducts 916, 918 of the body 216. For example, the exhalation duct 916 is positioned between the diverter plate 922 and the wall 902 and the exhalation duct 918 is disposed between the diverter plate 922 and the wall 904. The diverter plate 922 includes two planar surfaces 924, 926 separated by a bend 928 in the illustrated embodiment. Alternatively, the diverter plate 922 may include a different shape. For example, the diverter plate 922 may have an arcuate shape. The exhalation ducts 916, 918 direct exhaled air outward from the filter mask 100 (shown in FIG. 1) along the exhalation directions 110 (shown in FIG. 1). While two exhalation ducts 916, 918 are shown, alternatively a different number of ducts 916, 918 may be provided. For example, the diverter plate 922 has a bent shape that forms the two exhalation ducts 916, 918 between the opposing outer walls 902, 904. Alternatively, the diverter plate 922 may form three or more exhalation ducts. In another embodiment, the diverter plate 922 may include a single opening or be absent from the exhalation diverter body 216 to provide a single exhalation duct.

The exhalation diverter body 216 may be coupled to the filter mask 100 (shown in FIG. 1) such that exhaled air is permitted to exit the filter mask 100 only through the exhalation ducts 916, 918. Air that is exhaled by the wearer of the filter mask 100 strikes the deflection plate 900. The deflection plate 900, outer walls 902, 904, and the diverter plate 922 direct the exhaled air out of the exhalation diverter body 216 through the exhalation ducts 916, 918. As shown in FIGS. 9 through 11, the arcuate shape of the deflection plate 900 may cause the exhaled air to be directed rearward with respect to the direction in which the air is exhaled. For example, the shape of the deflection plate 900 may direct exhaled air away from the plane of interaction 106 (shown in FIG. 1) between the wearer (shown in FIG. 1) of the mask 100 and another person 104 (shown in FIG. 1) in one or more directions oriented away from the plane of interaction 106. The exhalation ducts 916, 918 may be arranged such that the exhaled air is directed away from the wearer of the filter mask 100 and/or from one or more persons with whom the wearer of the mask 100 is interacting. For example, the diverter plate 922 causes the exhalation ducts 916, 918 to diverge away from one another. The exhaled air passing through the separate exhalation ducts 916, 918 exits the exhalation diverter body 216 and is directed in diverging directions oriented away from one another and downward with respect to the filter mask 100. The exhaled air may be directed to pass below and away from the mask 100 such that the exhaled air is not trapped by or next to the wearer's body. For example, rather than directing the exhaled air directly downward into the wearer's body, the exhalation ducts 916, 918 may diverge away from one another to direct the air in divergent directions away from the center axis of the wearer.

The exhalation diverter body 216 may prevent backward flow of air from outside of the filter mask 100 (shown in FIG. 1). For example, the exhalation diverter body 216 forms the exhalation ducts 916, 918 such that ambient air is unable to backflow into the interior of the oronasal cup 200 (shown in FIG. 2). The path that ambient air must follow to backflow into the oronasal cup 200 through the exhalation diverter body 216 may be sufficiently tortuous so as to prevent the air from back flowing into the oronasal cup 200.

In one embodiment, the exhalation diverter body 216 includes a positive pressure leak check area 930 (shown in FIG. 10). The leak check area 930 may be used to perform a positive pressure leak check on the filter mask 100 (shown in FIG. 1). The leak check area 930 is a subsection of the diverter plate 922 that is approximately centrally located between the side walls 902, 904 and between the top side 920 and the lower end 230. Once a wearer dons the mask 100, the wearer may press the leak check area 930 inward toward the wearer's face until the leak check area 930 engages or abuts the portion of the oronasal cup 200 disposed between the leak check area 930 and the wearer's face. The engagement between the leak check area 930 and the oronasal cup 200 may block airflow through the exhalation diverter body 216. As the wearer exhales, a positive pressure is created in the interior chamber 1000 (shown in FIG. 12). If a leak between the wearer's face and the mask 100 exists, or if the wearer is donning a mask 100 that is too large or small, then the air in the interior chamber 1000 may exit the mask 100 through the leak or a gap between the mask 100 and the wearer's face, thus revealing the location of the leak or gap. If no leak exists or if the size of the mask 100 is correct, then the positive pressure may be maintained within the interior chamber 1000.

Figure 12:
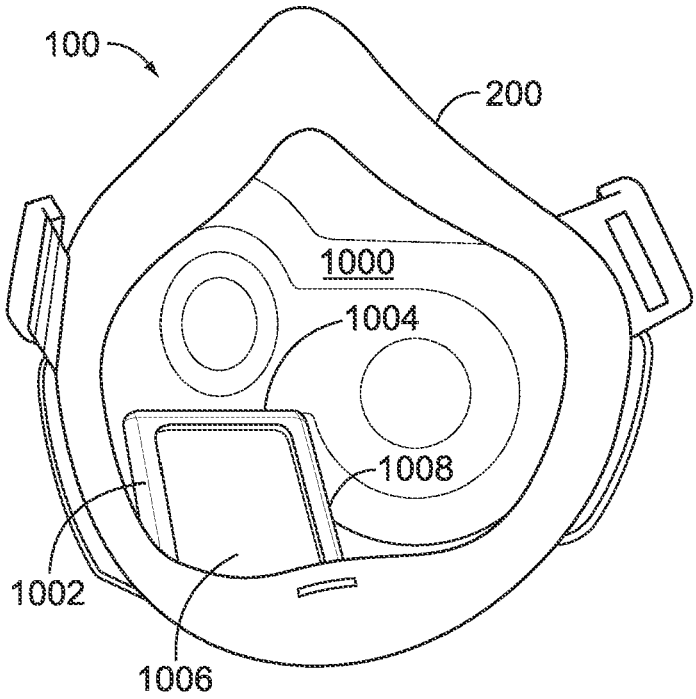
FIG. 12 is a perspective view of an oronasal cup shown in FIG. 2 and an interior flap in a closed position in accordance with one embodiment of the present disclosure.
Figure 13:
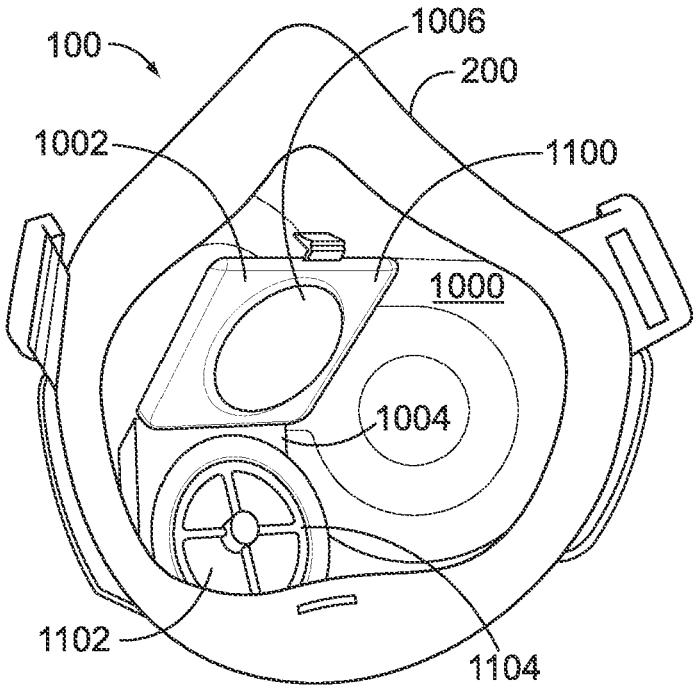
FIG. 13 is a perspective view of the oronasal cup shown in FIG. 2 and the interior flap shown in FIG. 10 in an open position in accordance with one embodiment.

FIG. 12 is a perspective view of the oronasal cup 200 and an interior flap 1002 in a closed position in accordance with one embodiment of the present disclosure. FIG. 13 is a perspective view of the oronasal cup 200 and the interior flap 1002 in an open position in accordance with one embodiment. The oronasal cup 200 includes the interior flap 1002 within the interior chamber 1000 of the oronasal cup 200. The interior flap 1002 may be coupled with the exhalation diverter body 216 (shown in FIG. 2). Alternatively, the interior flap 1002 may be joined with the oronasal cup 200. The interior flap 1002 is pivotally joined to the exhalation diverter body 216 or the oronasal cup 200 by a hinge 1004. For example, the interior flap 1002 may pivot between a closed position (shown in FIG. 12) and an open position (shown in FIG. 13).

The interior flap 1002 includes an opening 1006 that extends through the interior flap 1002 between opposite sides 1008 (shown in FIG. 12), 1100 (shown in FIG. 13) of the flap 1002. As shown in FIGS. 12 and 13, the opening 1006 may have different shapes on the different sides 1008, 1100. For example, the opening 1006 may be square shaped on the side 1008 and circular on the side 1100. The opening 1006 permits air, such as exhaled air, to pass through the interior flap 1002. A filter media, such as a fibrous planar filter media, may be disposed within the opening 1006 to filter exhaled air that passes through the flap 1002.

The interior flap 1002 encloses an exhalation filter 1102 (shown in FIG. 11) when the flap 1002 is pivoted to a closed position. The exhalation filter 1102 is disposed in an opening 1104 that extends through the oronasal cup 200 to the exhalation diverter body 216 (shown in FIG. 2). For example, the opening 1104 may provide a passageway that fluidly couples the plenum defined by the exhalation diverter body 216 and the oronasal cup 200. The exhalation filter 1102 may remove one or more contaminants, such as aerosols, pathogens, toxins, and the like, from air that is exhaled by the wearer of the filter mask 100. Exhaled air passes through the opening 1006 in the interior flap 1002. The air travels through the opening 1006 and into the exhalation filter 1102. The air is filtered by the exhalation filter 1102 and is conveyed to the space between the oronasal cup 200 and the exhalation diverter body 216 on the opposite side of the oronasal cup 200 that is shown in FIGS. 10 and 11. The filtered exhaled air may then be expelled from the filter mask 100 through the exhalation ducts 916, 918 (shown in FIG. 9), for example.

The interior flap 1002 may be pivoted to the open position to remove and/or replace the exhalation filter 1102 (shown in FIG. 11). Alternatively, the interior flap 1002 may include the exhalation filter 1102 in the opening 1006 of the flap 1002. In another embodiment, the oronasal cup 200 does not include the flap 1002 and may include an opening that fluidly couples the interior chamber 1000 of the oronasal cup 200 with the plenum defined by the exhalation diverter body 216 (shown in FIG. 2).

One or more embodiments of the filter mask 100 described herein may be used by healthcare professionals, first responders, emergency workers, and the like, to isolate their airflow away from a plane of interaction 106 (shown in FIG. 1) between the person 102 (shown in FIG. 1) wearing the mask 100 and another person 104 (shown in FIG. 1) with whom the wearer 102 is interacting. As described above, the wearer 102 may rotate the directional covers 206 (shown in FIG. 2) to cause air to be inhaled from areas or regions away from a sick patient. The exhalation diverter body 216 (shown in FIG. 2) may be used to direct exhaled air from the wearer 102 of the mask 100 away from the patient or person 104 with whom the wearer 102 is interacting.

The filter mask 100, filter covers 206 (shown in FIG. 2), and exhalation diverter body 216 (shown in FIG. 2) may be of sufficiently small profile such that the mask 100, filter covers 206, and the exhalation diverter body 216 do not interfere with or obstruct other gear worn by the wearer of the mask 100. For example, the mask 100, filter covers 206, and the exhalation diverter body 216 may be small enough to avoid contact or snagging on oxygen lines and other gears or tools used by the wearer of the mask 100. Additionally, the directional covers 206 may be rotated in various orientations to accommodate the positions of other gear worn by the wearer of the mask 100.

Figure 14:
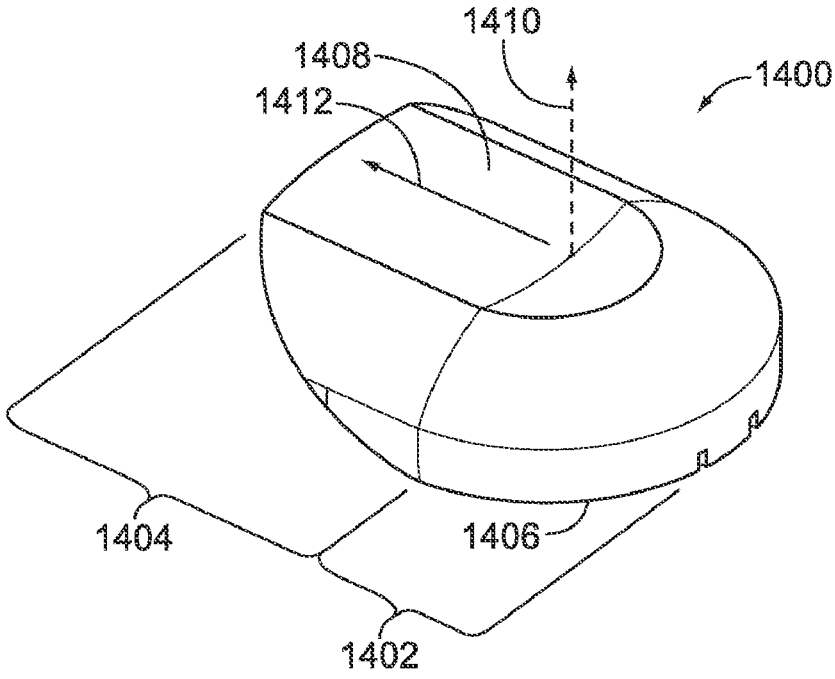
FIG. 14 is a perspective view of an inhalation directional cover in accordance with another embodiment of the present disclosure.
Figure 15:
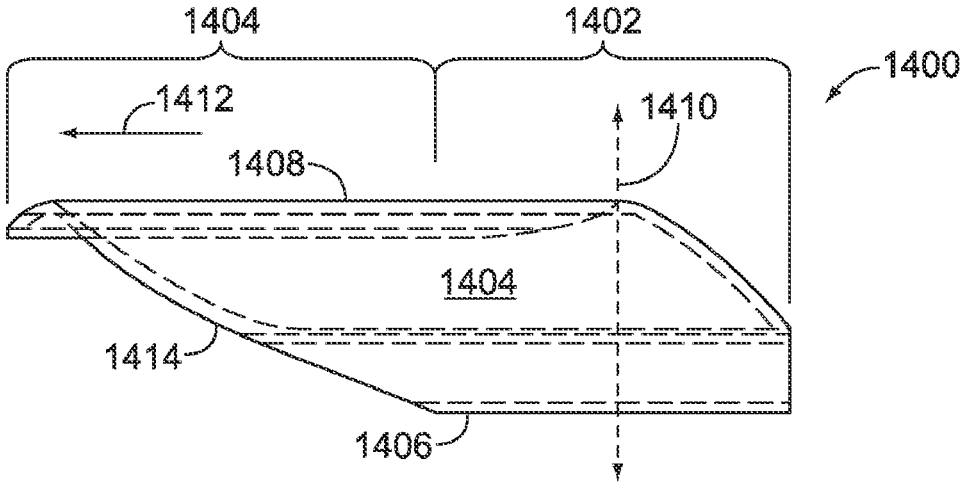
FIG. 15 is an elevational view of the directional cover shown in FIG. 14.

FIG. 14 is a perspective view of an inhalation directional cover 1400 in accordance with another embodiment of the present disclosure. FIG. 15 is an elevational view of the directional cover 1400 shown in FIG. 14. The directional cover 1400 may be similar to the directional cover 206 (shown in FIG. 2). For example, the directional cover 1400 may be rotatably coupled to the filter 204 (shown in FIG. 2) and/or the filter cover 300 (shown in FIG. 3) to control the directions and/or locations from which air is inhaled into the filter mask 100 (shown in FIG. 1). The directional cover 1400 includes a coupling portion 1402 and a wing portion 1404. The coupling portion 1400 defines a plenum 1404 through which inhaled air passes when the wearer of the mask 100 (shown in FIG. 1) inhales. The coupling portion 1404 extends between a connection end 1406 and an outer surface 1408 along a rotation axis 1410. Similar to the outer surface 228 (shown in FIG. 2), the outer surface 1408 is a closed surface in the illustrated embodiment. For example, the outer surface 1408 may prevent air from passing through the outer surface 1408 and into the plenum 1404.

The connection end 1406 is rotatably mounted to the filter 204 (shown in FIG. 2). For example, the connection end 1406 may be an arcuate wall that extends between opposite ends around a portion of the periphery of the filter 204. The connection end 1406 provides an opening through which inhaled air passes from the plenum 1404 and into the filter 204.

The rotation axis 1410 is the axis about which the directional cover 1400 rotates relative to the mask 100 (shown in FIG. 1). In one embodiment, the rotation axis 1410 is parallel to or coextensive with the center axis 208 (shown in FIG. 2) of the filter 204 (shown in FIG. 2) to which the directional cover 1400 is mounted. Alternatively, the rotation axis 1410 may be angled with respect to the center axis 208 of the filter 204.

The wing portion 1404 is an elongated extension of the coupling portion 1402 that extends from the coupling portion 1402 along an elongation direction 1412. The wing portion 1404 extends from an intake end 1414 to the outer surface 1408 in a direction that is obliquely oriented with respect to the rotation axis 1410. For example, the intake end 1414 may be disposed at an oblique angle with respect to the outer surface 1408 and the connection end 1406. In the illustrated embodiment, the intake end 1414 defines an opening through which inhaled air enters the directional cover 1400. For example, the directional cover 1400 may be substantially closed to the surrounding atmosphere with the outer surface 1408 preventing the ingress of air or fluid into the plenum 1404 while the intake end 1414 may include one or more openings through which inhaled air enters the plenum 1408. In one embodiment, the intake end 1414 is open from the outer surface 1408 to the connection end 1406. Alternatively, the intake end 1414 may be a closed surface similar to the outer surface 1408 with one or more openings extending through the intake end 1414. For example, the intake end 1414 may include a filter media or body that filters inhaled air prior to entering the plenum 1404.

The directional cover 1400 may be substantially sealed from the surrounding atmosphere but for the intake end 1414. For example, the body of the directional cover 1400 may prevent the ingress of air or fluid into the plenum 1404 except for through the intake end 1414. The orientation of the intake end 1414 relative to the mask 100 (shown in FIG. 1) may then determine the locations from which air is drawn into the directional cover 1400 and the mask 100. The wing portion 1404 may define the inhalation duct or conduit through which inhaled air is drawn into the filter 204 (shown in FIG. 2) to which the directional cover 1400 is mounted.

In one embodiment, the plenum 1404 may be sufficiently large such that the directional cover 1400 does not significantly restrict airflow into the filter 204 (shown in FIG. 2) and/or reduce the filtration efficiency of the filter. For example, the plenum 1404 may define a conduit that has a cross-sectional area for inhaled airflow that is as large as or larger than the cross-sectional area of the intake interface 810 (shown in FIG. 8) of the filter 204, similar to the plenum 804 (shown in FIG. 8).

Figure 16:
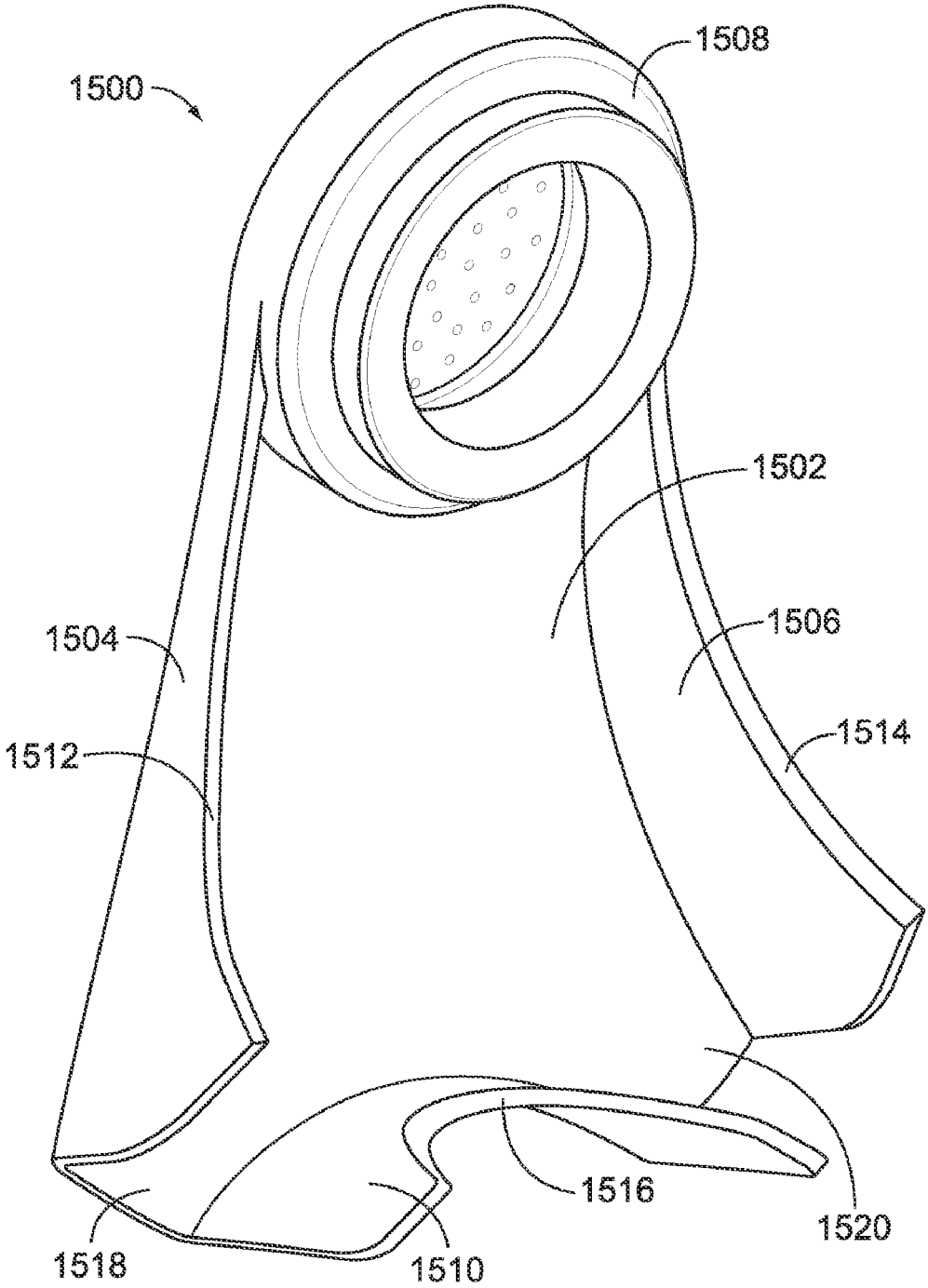
FIG. 16 is a perspective view of an exhalation diverter body in accordance with another embodiment of the present disclosure.

FIG. 16 is a perspective view of an exhalation diverter body 1500 in accordance with another embodiment of the present disclosure. The exhalation diverter body 1500 may be similar to the exhalation diverter body 216 (shown in FIG. 2). For example, the exhalation diverter body 1500 may be coupled with the oronasal cup 200 (shown in FIG. 2) to divert exhaled air away from a plane of interaction 106 (shown in FIG. 1) between a person 102 (shown in FIG. 1) wearing the mask 100 (shown in FIG. 1) and a person 104 (shown in FIG. 1) with whom the person 102 is interacting. The exhalation diverter body 1500 may be a flexible body formed from a dielectric or elastomeric material, such as one or more polymers. The exhalation diverter 1500 may be fixed to the mask 100 or the oronasal cup 200 such that the exhalation diverter body 1500 cannot be separated from the mask 100 or oronasal cup 200 without damaging the body 1500. Alternatively, the exhalation diverter body 1500 may be removably coupled to the oronasal cup 200.

The exhalation diverter body 1500 includes a deflection plate 1502 that laterally extends between two opposing outer walls 1504, 1506. The deflection plate 1500 also longitudinally extends between a ring body 1508 to a lower outer wall 1510. The outer walls 1504, 1506, 1510 extend from the deflection plate 1502 to corresponding sealing edges 1512-1516 in directions that are obliquely or perpendicularly oriented with respect to the deflection plate 1502. The ring body 1508 and the sealing edges 1512-1516 may engage the oronasal cup 200 (shown in FIG. 2) to define a plenum between the exhalation diverter body 1500 and the oronasal cup 200. The sealing edges 1512-1516 and the ring body 1508 may be sealed to the oronasal cup 200 to prevent air from being passing through an interface between the oronasal cup 200 and any of the sealing edges 1512-1516 and the ring body 1508.

The deflection plate 1500 and outer walls 1504, 1506, 1510 define exhalation ducts 1518, 1520 that direct exhaled air outward from the filter mask 100 (shown in FIG. 1) along the exhalation directions 110 (shown in FIG. 1). While two exhalation ducts 1518, 1520 are shown, alternatively a different number of ducts 1518, 1520 may be provided. The outer wall 1510 may have an arcuate shape that forms the two exhalation ducts 1518, 1520 between the opposing outer walls 1504, 1506. Alternatively, the outer wall 1510 may form three or more exhalation ducts. In another embodiment, the outer wall 1510 may include a single opening or be absent from the exhalation diverter body 1500 to provide a single exhalation duct between the outer walls 1504, 1506.

The exhalation diverter body 1500 may be coupled to the filter mask 100 (shown in FIG. 1) such that exhaled air is permitted to exit the filter mask 100 only through the exhalation ducts 1518, 1520. Air that is exhaled by the wearer of the filter mask 100 strikes the deflection plate 1502. The exhaled air is diverted by the deflection plate 1502 toward the outer walls 1504, 1506, 1510. The deflection plate 1502 and outer walls 1504, 1506, 1510 direct the exhaled air out of the exhalation diverter body 1500 through the exhalation ducts 1518, 1520. The exhalation ducts 1518, 1520 may be arranged such that the exhaled air is directed away from the wearer of the filter mask 100 and/or from one or more persons with whom the wearer of the mask 100 is interacting. For example, the exhalation ducts 1518, 1520 in the illustrated embodiment diverge away from one another. The exhaled air passing through the separate exhalation ducts 1518, 1520 exits the exhalation diverter body 1500 and is directed in diverging directions oriented away from one another and downward with respect to the filter mask 100. The exhaled air may be directed to pass below and away from the mask 100 such that the exhaled air is not trapped by or next to the wearer's body. For example, rather than directing the exhaled air directly downward into the wearer's body, the exhalation ducts 1518, 1520 may diverge away from one another to direct the air in divergent directions away from the center axis of the wearer.

The exhalation diverter body 1500 may prevent backward flow of air from outside of the filter mask 100 (shown in FIG. 1). For example, the exhalation diverter body 1500 forms the exhalation ducts 1518, 1520 such that ambient air is unable to backflow into the interior of the oronasal cup 200 (shown in FIG. 2). The path that ambient air must follow to backflow into the oronasal cup 200 through the exhalation diverter body 1500 may be sufficiently tortuous so as to prevent the air from back flowing into the oronasal cup 200.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A filter mask comprising:

an oronasal cup configured to enclose a nose and mouth of a user and to fluidly couple with a filter that filters air passing through the filter along a center axis of the filter;

an inhalation directional cover configured to be joined to the filter, the inhalation directional cover comprising an elongated wing portion oriented in an inhalation direction that is angled with respect to the center axis of the filter, wherein the inhalation directional cover is rotatably coupled to the filter, the inhalation directional cover rotatable about the center axis of the filter to vary orientation of the inhalation direction; and an exhalation diverter body fluidly coupled with the oronasal cup, the exhalation diverter body defining an exhalation duct that directs exhaled air out of the oronasal cup along an exhalation direction, wherein the inhalation direction and the exhalation direction are oriented away from a plane of interaction between the user and another person.

2. The filter mask of claim 1, further comprising a filter cover configured to be coupled to the filter and disposed between the filter and the inhalation directional cover, the filter cover permitting air to be inhaled through the filter cover and into the filter while blocking passage of droplet spray into the filter.

3. The filter mask of claim 1, further comprising a filter cover configured to be coupled to the filter, the filter cover comprising an engagement portion adapted to couple with the filter and an enclosure portion removably joined with the engagement portion, wherein the filter cover receives a filter media between the engagement portion and the enclosure portion that filters air prior to the air entering the filter.

4. The filter mask of claim 1, wherein the inhalation directional cover provides a plenum between the filter and the inhalation directional cover, the plenum defining a conduit having a cross-sectional area through which inhaled air passes that is at least as large as an air intake interface of the filter.

5. The filter mask of claim 1, wherein the exhalation diverter body directs exhaled air downward from the nose and mouth of the user.

6. The filter mask of claim 1, wherein the exhalation direction is a first exhalation direction, and the exhalation diverter body includes multiples ones of the duct that direct exhaled air along the first exhalation direction and a second exhalation direction, the first and second exhalation directions diverging away from one another and downward with respect to the nose and the mouth of the user.

7. The filter mask of claim 1, wherein the exhalation diverter body includes an opening configured to receive a voice transmitter.

8. The filter mask of claim 1, wherein the inhalation directional cover is rotatably coupled to the filter such that the inhalation directional cover rotates with respect to the filter.

9. The filter mask of claim 1, wherein the inhalation directional cover is selectively positionable at a plurality of different inhalation directions.

10. The filter mask of claim 1, wherein the inhalation directional cover is selectively positionable at a plurality of different inhalation directions, the inhalation directional cover comprising a plurality of protrusions that engage corresponding cavities in the filter or a filter cover at corresponding positions.

11. A filter mask comprising:

an oronasal cup configured to enclose a nose and mouth of a user;

a filter joined with the oronasal cup and fluidly coupled with the oronasal cup, the filter removing contaminants from air inhaled into the oronasal cup and through the filter along a center axis of the filter; and an inhalation directional cover comprising an engagement portion rotatably connected to the filter and an elongated wing portion oriented in an inhalation direction that is angled away from the center axis of the filter, the inhalation directional cover forming a duct through which air is inhaled into the filter along the inhalation direction, wherein the inhalation directional cover is rotatable around the center axis of the filter to vary orientation of the inhalation direction.

12. The filter mask of claim 11, further comprising a filter cover coupled to the filter between the filter and the inhalation directional cover, the filter cover blocking passage of aerosols from inhaled air into the filter.

13. The filter mask of claim 11, further comprising a filter cover including an engagement portion coupled to the filter and an enclosure portion removably joined with the engagement portion, wherein the filter cover receives a pre-filter element between the engagement portion and the enclosure portion that filters inhaled air prior to the air entering the filter.

14. The filter mask of claim 11, further comprising an exhalation diverter body fluidly coupled with the oronasal cup, the exhalation diverter body defining an exhalation duct that directs exhaled air out of the oronasal cup along an exhalation direction oriented away from a plane of interaction between the user and another person.

15. The filter mask of claim 11, further comprising an exhalation diverter body fluidly coupled with the oronasal cup, the exhalation diverter body including exhalation ducts that direct exhaled air out of the oronasal cup along divergent exhalation directions oriented away from one another and from a plane of interaction between the user and another person.

16. The filter mask of claim 11, wherein the inhalation directional cover can be at least one of removed, cleaned, or reused without at least one of removing or replacing the filter from the filter mask.

17. A filter mask comprising:

an oronasal cup configured to enclose a nose and mouth of a user;

an inhalation duct rotatably coupled with the oronasal cup, the inhalation duct rotatable with respect to the oronasal cup to vary a location from which air is inhaled from surrounding atmosphere into the oronasal cup; and an exhalation duct fluidly coupled with the oronasal cup, the exhalation duct directing exhaled air downward from the oronasal cup with respect to the nose and mouth of the user into the surrounding atmosphere, wherein the inhalation duct and the exhalation duct direct intake and exhalation of air, respectively, along directions away from a plane of interaction between the user and another person with whom the user is interacting.

18. The filter mask of claim 17, wherein the oronasal cup is configured to couple with a filter that filters air as the air enters the filter through an intake interface and passes through the filter to an outlet interface, the inhalation duct rotatably coupled to the filter about the center axis to vary an inhalation direction along which air is inhaled through the inhalation duct.

19. The filter mask of claim 17, wherein the exhalation duct is a first exhalation duct, further comprising a second exhalation duct fluidly coupled with the oronasal cup, the first and second exhalation ducts directing exhaled air in diverging directions away from one another.

20. The filter mask of claim 17, wherein the exhalation duct directs exhaled air at least one of rearward or toward a shoulder of the user.

* * * * *